US006175288B1

(12) United States Patent
Castonguay et al.

(10) Patent No.: US 6,175,288 B1
(45) **Date of Patent: *Jan. 16, 2001**

(54) SUPPLEMENTAL TRIP UNIT FOR ROTARY CIRCUIT INTERRUPTERS

(75) Inventors: Roger N. Castonguay, Terryville; Thomas F. Papallo, Plainville; Randall L. Greenberg, Granby; Girish Hassan, Plainville, all of CT (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/384,495

(22) Filed: Aug. 27, 1999

(51) Int. Cl.[7] ..... H01H 75/00
(52) U.S. Cl. ..... 335/16; 335/167; 218/22
(58) Field of Search ..... 335/16, 35, 167–176; 218/22

(56) References Cited

U.S. PATENT DOCUMENTS

| | | | |
|---|---|---|---|
| D. 367,265 | 2/1996 | Yamagata et al. . | |
| 2,340,682 | 2/1944 | Powell . | |
| 2,719,203 | 9/1955 | Gelzheiser et al. . | |
| 2,937,254 | 5/1960 | Ericson . | |
| 3,158,717 | 11/1964 | Jencks et al. | 200/116 |
| 3,162,739 | 12/1964 | Klein et al. | 200/88 |
| 3,197,582 | 7/1965 | Norden | 200/50 |
| 3,307,002 | 2/1967 | Cooper | 200/116 |
| 3,464,040 | 8/1969 | Powell . | |
| 3,517,356 | 6/1970 | Hanafusa | 335/16 |
| 3,548,358 * | 12/1970 | Klein | 335/116 |
| 3,631,369 | 12/1971 | Menocal | 337/110 |
| 3,803,455 | 4/1974 | Willard . | |
| 3,883,781 | 5/1975 | Cotton | 317/14 R |
| 4,129,762 | 12/1978 | Bruchet . | |
| 4,144,513 | 3/1979 | Shafer et al | 335/46 |
| 4,158,119 | 6/1979 | Krakik | 200/240 |
| 4,165,453 | 8/1979 | Hennemann . | |
| 4,166,988 | 9/1979 | Ciarcia et al. | 335/9 |
| 4,220,934 | 9/1980 | Wafer et al. | 335/16 |
| 4,259,651 | 3/1981 | Yamat | 335/16 |
| 4,263,492 | 4/1981 | Maier et al. | 200/288 |
| 4,276,527 | 6/1981 | Gerbert-Gaillard et al. | 335/39 |
| 4,297,663 | 10/1981 | Seymour et al. | 335/20 |
| 4,301,342 | 11/1981 | Castonguay et al. . | |
| 4,360,852 | 11/1982 | Gilmore | 361/98 |
| 4,368,444 | 1/1983 | Preuss et al. | 335/166 |
| 4,375,022 | 2/1983 | Daussin et al. . | |
| 4,376,270 | 3/1983 | Staffen | 335/21 |
| 4,383,146 | 5/1983 | Bur . | |
| 4,392,036 | 7/1983 | Troebel et al. | 200/322 |
| 4,393,283 | 7/1983 | Masuda . | |
| 4,401,872 | 8/1983 | Boichot-Castagne et al. . | |

(List continued on next page.)

FOREIGN PATENT DOCUMENTS

| | | |
|---|---|---|
| 819 008 | 12/1974 | (BE) . |
| 12 27 978 | 11/1966 | (DE) . |
| 30 47 360 | 6/1982 | (DE) . |

(List continued on next page.)

* cited by examiner

*Primary Examiner*—Lincoln Donovan
*Assistant Examiner*—Tuyen Nguyen
(74) *Attorney, Agent, or Firm*—Cantor Colburn LLP; Carl B. Horton

(57) ABSTRACT

A supplemental magnetic trip unit is arranged on the load strap of an industrial-rated circuit breaker to interrupt circuit current upon occurrence of a short circuit fault. The trip unit employs a U-shaped magnet and a hinged armature that articulates the circuit breaker operating mechanism latch to allow the circuit breaker contacts to become separated upon the urgence of the powerful circuit breaker operating mechanism springs.

14 Claims, 3 Drawing Sheets

U.S. PATENT DOCUMENTS

| | | | | |
|---|---|---|---|---|
| 4,468,645 | | 8/1984 | Gerbert-Gaillard | 335/42 |
| 4,470,027 | | 9/1984 | Link et al. | 335/16 |
| 4,479,143 | | 10/1984 | Watanabe et al. . | |
| 4,488,133 | | 12/1984 | McClellan et al. | 335/16 |
| 4,492,941 | | 1/1985 | Nagel | 335/13 |
| 4,541,032 | | 9/1985 | Schwab | 361/331 |
| 4,546,224 | | 10/1985 | Mostosi . | |
| 4,550,360 | | 10/1985 | Dougherty | 361/93 |
| 4,562,419 | | 12/1985 | Preuss et al. | 335/195 |
| 4,595,812 | | 6/1986 | Tamaru et al. | 200/307 |
| 4,611,187 | | 9/1986 | Banfi | 335/16 |
| 4,612,430 | | 9/1986 | Sloan et al. | 200/327 |
| 4,616,198 | | 10/1986 | Pardini | 335/16 |
| 4,642,431 | | 2/1987 | Tedesco et al. . | |
| 4,644,438 | | 2/1987 | Puccinelli et al. | 361/75 |
| 4,649,247 | | 3/1987 | Preuss et al. . | |
| 4,658,322 | | 4/1987 | Rivera | 361/37 |
| 4,672,501 | | 6/1987 | Bilac et al. | 361/96 |
| 4,675,481 | | 6/1987 | Markowski et al. . | |
| 4,682,264 | | 7/1987 | Demeyer | 361/96 |
| 4,689,712 | | 8/1987 | Demeyer | 361/96 |
| 4,694,373 | | 9/1987 | Demeyer | 361/96 |
| 4,710,845 | | 12/1987 | Demeyer | 361/96 |
| 4,717,985 | | 1/1988 | Demeyer | 361/96 |
| 4,733,211 | | 3/1988 | Castonguay et al. | 335/192 |
| 4,733,321 | | 3/1988 | Lindeperg | 361/96 |
| 4,764,650 | | 8/1988 | Bur et al. . | |
| 4,768,007 | | 8/1988 | Mertz et al. | 335/202 |
| 4,780,786 | | 10/1988 | Weynachter et al. | 361/87 |
| 4,831,221 | | 5/1989 | Yu et al. . | |
| 4,870,531 | | 9/1989 | Danek et al. | 361/93 |
| 4,883,931 | | 11/1989 | Batteux et al. . | |
| 4,884,047 | | 11/1989 | Baginski et al. | 335/10 |
| 4,884,164 | | 11/1989 | Dzuira et al. | 361/97 |
| 4,900,882 | | 2/1990 | Bernard et al. | 200/147 R |
| 4,902,864 | * | 2/1990 | Markowski et al. | 200/459 |
| 4,910,485 | | 3/1990 | Bolongeat-Mobleu et al. . | |
| 4,914,541 | | 4/1990 | Tripodi et al. | 361/94 |
| 4,916,421 | | 4/1990 | Pardini et al. | 335/185 |
| 4,926,282 | | 5/1990 | McGhie | 361/102 |
| 4,937,706 | | 6/1990 | Schueller et al. | 361/396 |
| 4,939,492 | | 7/1990 | Raso et al. | 335/42 |
| 4,943,691 | | 7/1990 | Mertz et al. | 200/151 |
| 4,943,888 | | 7/1990 | Jacob et al. | 361/96 |
| 4,950,855 | | 8/1990 | Bolonegeat-Mobleu et al. . | |
| 4,951,019 | | 8/1990 | Gula | 335/166 |
| 4,952,897 | | 8/1990 | Barnel et al. | 335/147 |
| 4,958,135 | | 9/1990 | Baginski et al. | 335/8 |
| 4,965,543 | | 10/1990 | Batteux | 335/174 |
| 4,983,788 | | 1/1991 | Pardini | 200/16 R |
| 5,001,313 | | 3/1991 | Leclerq et al. . | |
| 5,004,878 | | 4/1991 | Seymour et al. . | |
| 5,029,301 | | 7/1991 | Nebon et al. | 335/16 |
| 5,030,804 | | 7/1991 | Abri . | |
| 5,057,655 | | 10/1991 | Kersusan et al. . | |
| 5,077,627 | | 12/1991 | Fraisse | 361/93 |
| 5,083,081 | | 1/1992 | Barrault et al. | 324/126 |
| 5,095,183 | | 3/1992 | Raphard et al. . | |
| 5,103,198 | | 4/1992 | Morel et al. . | |
| 5,115,371 | | 5/1992 | Tripodi | 361/106 |
| 5,120,921 | | 6/1992 | DiMarco et al. | 200/401 |
| 5,132,865 | | 7/1992 | Mertz et al. | 361/6 |
| 5,138,121 | | 8/1992 | Streich et al. | 200/293 |
| 5,140,115 | | 8/1992 | Morris | 200/308 |
| 5,153,802 | | 10/1992 | Mertz et al. | 361/18 |
| 5,155,315 | | 10/1992 | Malkin et al. . | |
| 5,166,483 | | 11/1992 | Kersusan et al. . | |
| 5,172,087 | | 12/1992 | Castonguay et al. | 335/160 |
| 5,178,504 | | 1/1993 | Falchi | 411/553 |
| 5,184,717 | | 2/1993 | Chou et al. | 200/401 |
| 5,187,339 | | 2/1993 | Lissandrin . | |
| 5,198,956 | | 3/1993 | Dvorak | 361/106 |
| 5,200,724 | | 4/1993 | Gula et al. | 335/166 |
| 5,210,385 | | 5/1993 | Morel et al. . | |
| 5,239,150 | | 8/1993 | Bolongeat-Mobleu et al. . | |
| 5,260,533 | | 11/1993 | Livesey et al. | 200/401 |
| 5,262,744 | | 11/1993 | Arnold et al. | 335/8 |
| 5,280,144 | | 1/1994 | Bolongeat-Mobleu et al. . | |
| 5,281,776 | | 1/1994 | Morel et al. . | |
| 5,296,660 | | 3/1994 | Morel et al. . | |
| 5,296,664 | | 3/1994 | Crookston et al. | 200/401 |
| 5,298,874 | | 3/1994 | Morel et al. | 335/8 |
| 5,300,907 | | 4/1994 | Nereau et al. | 335/172 |
| 5,313,180 | | 5/1994 | Vial et al. | 335/16 |
| 5,317,471 | | 5/1994 | Izoard et al. | 361/105 |
| 5,319,167 | | 6/1994 | Juds et al. | 200/144 R |
| 5,331,500 | | 7/1994 | Corcoles et al. | 361/93 |
| 5,334,808 | | 8/1994 | Bur et al. | 200/50 |
| 5,341,191 | | 8/1994 | Crookston et al. | 335/16 |
| 5,347,096 | | 9/1994 | Bolongeat-Mobleu et al. . | |
| 5,347,097 | | 9/1994 | Bolongeat-Mobleu et al. . | |
| 5,350,892 | | 9/1994 | Rozier . | |
| 5,357,066 | | 10/1994 | Morel et al. . | |
| 5,357,068 | | 10/1994 | Rozier . | |
| 5,357,394 | | 10/1994 | Piney | 361/72 |
| 5,361,052 | | 11/1994 | Ferullo et al. | 335/172 |
| 5,373,130 | | 12/1994 | Barrault et al. . | |
| 5,379,013 | | 1/1995 | Coudert | 335/17 |
| 5,424,701 | | 6/1995 | Castonguary et al. | 335/172 |
| 5,438,176 | | 8/1995 | Bonnardel et al. | 200/400 |
| 5,440,088 | | 8/1995 | Coudet et al. | 200/303 |
| 5,449,871 | | 9/1995 | Batteux et al. | 200/401 |
| 5,450,048 | | 9/1995 | Leger et al. | 335/132 |
| 5,451,729 | | 9/1995 | Onderka et al. | 200/18 |
| 5,457,295 | | 10/1995 | Tanibe et al. . | |
| 5,467,069 | | 11/1995 | Payet-Burin et al. | 335/42 |
| 5,469,121 | | 11/1995 | Payet-Burin | 335/16 |
| 5,475,558 | | 12/1995 | Barjonnet et al. | 361/64 |
| 5,477,016 | | 12/1995 | Baginski et al. . | |
| 5,479,143 | | 12/1995 | Payet-Burin | 335/202 |
| 5,485,343 | | 1/1996 | Santos et al. | 361/115 |
| 5,493,083 | | 2/1996 | Olivier . | |
| 5,504,284 | | 4/1996 | Lazareth et al. . | |
| 5,504,290 | | 4/1996 | Baginski et al. . | |
| 5,510,761 | | 4/1996 | Boder et al. | 335/172 |
| 5,512,720 | | 4/1996 | Coudet et al. | 200/400 |
| 5,515,018 | | 5/1996 | DiMarco et al. | 335/16 |
| 5,519,561 | | 5/1996 | Mrenna et al. | 361/105 |
| 5,534,674 | | 7/1996 | Steffens | 218/154 |
| 5,534,832 | | 7/1996 | Duchemin et al. | 335/16 |
| 5,534,835 | | 7/1996 | McColloch et al | 335/172 |
| 5,534,840 | | 7/1996 | Cuingnet . | |
| 5,539,168 | | 7/1996 | Linzenich | 200/303 |
| 5,543,595 | | 8/1996 | Mader et al. | 200/401 |
| 5,552,755 | | 9/1996 | Fello et al. | 335/18 |
| 5,581,219 | | 12/1996 | Nozawa et al. | 335/132 |
| 5,604,656 | | 2/1997 | Derrick et al. | 361/187 |
| 5,608,367 | | 3/1997 | Zoller et al. | 335/132 |
| 5,784,233 | | 7/1998 | Bastard et al. | 361/36 |
| 5,797,483 | | 8/1998 | Smith et al. . | |

FOREIGN PATENT DOCUMENTS

| | | |
|---|---|---|
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |

| | | |
|---|---|---|
| 0 0174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 339 282 | 11/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 560 697 | 9/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 0 889 498 | 1/1999 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

SUPPLEMENTAL TRIP UNIT FOR ROTARY CIRCUIT INTERRUPTERS

BACKGROUND OF THE INVENTION

This invention relates to rotary circuit breakers, and, more particularly to a Supplemental Trip Unit for Rotary Circuit Interrupters.

U.S. Pat. No. 4,616,198 entitled Contact Arrangement for a Current Limiting Circuit Breaker, describes an early use of a first and second pair of circuit breaker contacts arranged in series to substantially reduce the amount of current let-through upon the occurrence of an overcurrent condition.

When the contact pairs are arranged upon one movable contact arm such as described within U.S. Pat. No. 4,910,485 entitled Multiple Circuit Breaker with Double Breaker Rotary Contact, some means must be provided to insure that the opposing contact pairs open rapidly upon occurrence of a short circuit overcurrent condition within the protected circuit.

U.S. Pat. No. 4,672,501 entitled Circuit Breaker and Protective Relay Unit, describes electronic circuits employed to determine the occurrence of an overcurrent condition and current transformers are employed to sense circuit current. However, when rotary contacts are employed with electronic circuits, the current transformer cores can become saturated upon occurrence of a short circuit overcurrent and an auxiliary trip unit must be employed to insure short circuit overcurrent protection.

Short circuit overcurrent protection in rotary contact circuit breakers is described in U.S. Pat. No. 5,103,198 entitled Instantaneous Trip Device of a Circuit Breaker, wherein the overpressure developed within the circuit breaker arc chamber upon contact separation in one pole drives a piston against the operating mechanism trip bar to actuate contact separation in the remaining circuit breaker poles. It has since been determined that the overpressure response is sensitive to voltage levels upon arc occurrence, and less sensitive to short circuit current values.

SUMMARY OF THE INVENTION

In an exemplary embodiment of the present invention, a supplemental magnetic trip unit is arranged on the load strap of an industrial-rated circuit breaker to interrupt circuit current upon occurrence of a short circuit fault. The trip unit employs a U-shaped magnet and a hinged armature that articulates the circuit breaker operating mechanism latch to allow the circuit breaker contacts to become separated upon the urgence of the powerful circuit breaker operating mechanism springs. A return spring mounted between the trip slide and the circuit breaker operating mechanism sideframe allows the armature to return automatically to a home position. Thus providing a low cost auxiliary trip unit for use with circuit breakers employing rotary contacts for short circuit overcurrent protection.

DESCRIPTION OF THE PREFERRED EMBODIMENT

Before describing the auxiliary magnetic trip unit of the invention, it is helpful to review a so-called "thermal magnetic trip unit", as described, for example in U.S. Pat. No. 3,464,040 entitled Compact Circuit Breaker Construction, which is incorporated by reference. A bimetal element is connected with the associated electric circuit for long term overcurrent detection and interrupting the circuit when the overcurrent persists for a predetermined period of time. The time for the heat to become dissipated from the bimetal provides the time factor in the predetermined current/time value. A magnetic element in the form of a U-shaped magnet is employed for short time overcurrent detection and interrupting the circuit when the overcurrent persists for a shorter predetermined period of time. The magnet partially surrounds the current-carrying bimetal and electromagnetically interacts with a pivotal armature member to interrupt circuit current within a shorter period of time based on the exponential increase in magnetic attraction between the magnet and the armature as the armature begins to move toward the magnet. The electronic trip unit providing the long time and short time overcurrent determination from data stored within electronic memory.

Figure 1:
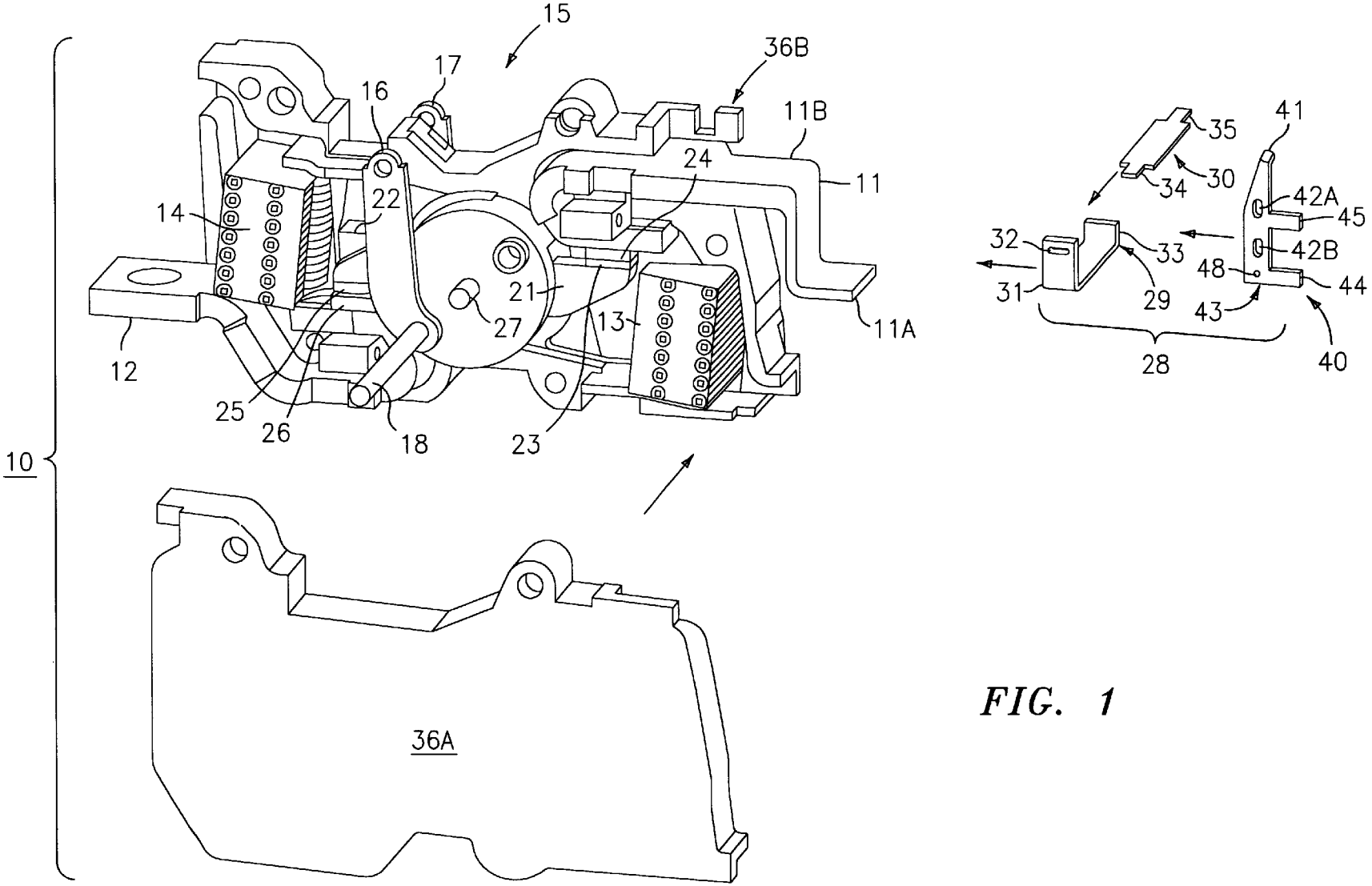
FIG. 1 is a top perspective view of a circuit breaker assembly of the type employing a rotary contact operating mechanism with the supplemental magnetic trip unit components in isometric projection, of the present invention.

Referring to FIG. 1, a circuit breaker rotary contact assembly is generally shown at 10 and is similar to that described within the U.S. patent application Ser. No. 09/348,908 entitled Rotary Contact Assembly for High-Ampere Rated Circuit Breakers, filed concurrently herewith, which is incorporated by reference. Opposing line and load straps 11, 12 are adapted for connection with an associated electrical distribution system and a protected electric circuit, respectively. Fixed contacts 24, 26 connect with the line and load straps while the moveable contacts 23, 25 are attached to ends of moveable contact arms 21, 22 for making movable connection with the associated fixed contacts to complete the circuit connection with the line and load straps 11, 12. The movable contact arms 21, 22 are of unitary structure and rotate within a rotor and contact arm assembly 15 about a contact arm pivot 27 when rotated upon response to the circuit breaker operating mechanism (not shown) by connection via pins 18 and a pair of opposing levers 16, 17. The arcs generated when contacts 23, 24 and 25, 26 are separated upon overload circuit current conditions are cooled and quenched within arc chambers 13, 14 to interrupt current through the protected circuit. A supplemental magnetic trip unit 28 is attached to the load end of the circuit breaker 10 by positioning a U-shaped magnet 29 on a top part 11B of the load strap 11 with a sidearm 31 containing an armature slot 32 extending about a sidearm 33. Plastic cassette sidepieces 36A, 36B, insulate the supplemental magnetic trip unit 28 shown within the sidepieces 36A and B, with sidepiece 36A shown unattached. An armature 30 is positioned onto the magnet by insertion of a pivot arm 34, shaped on one end of the armature within the armature slot such that an actuator arm 35, shaped on the opposite end of the armature, extends above the sidearm 33. A trip slide unit 40 in the form of a shaped plate 43, containing slotted openings 42A and B is positioned next to the magnet/armature assembly 29, 30 by locating a bottom arm 44 containing a retainer pin 48 under the magnet/armature assembly and arranging a top arm 45 under the actuator arm 35. A trip tab 41, extending from the top of a shaped plate 43 becomes positioned above a circuit breaker operating assembly latch 39, on an operating mechanism sideframe 38, as best seen by now referring to FIG. 2.

Figure 2:
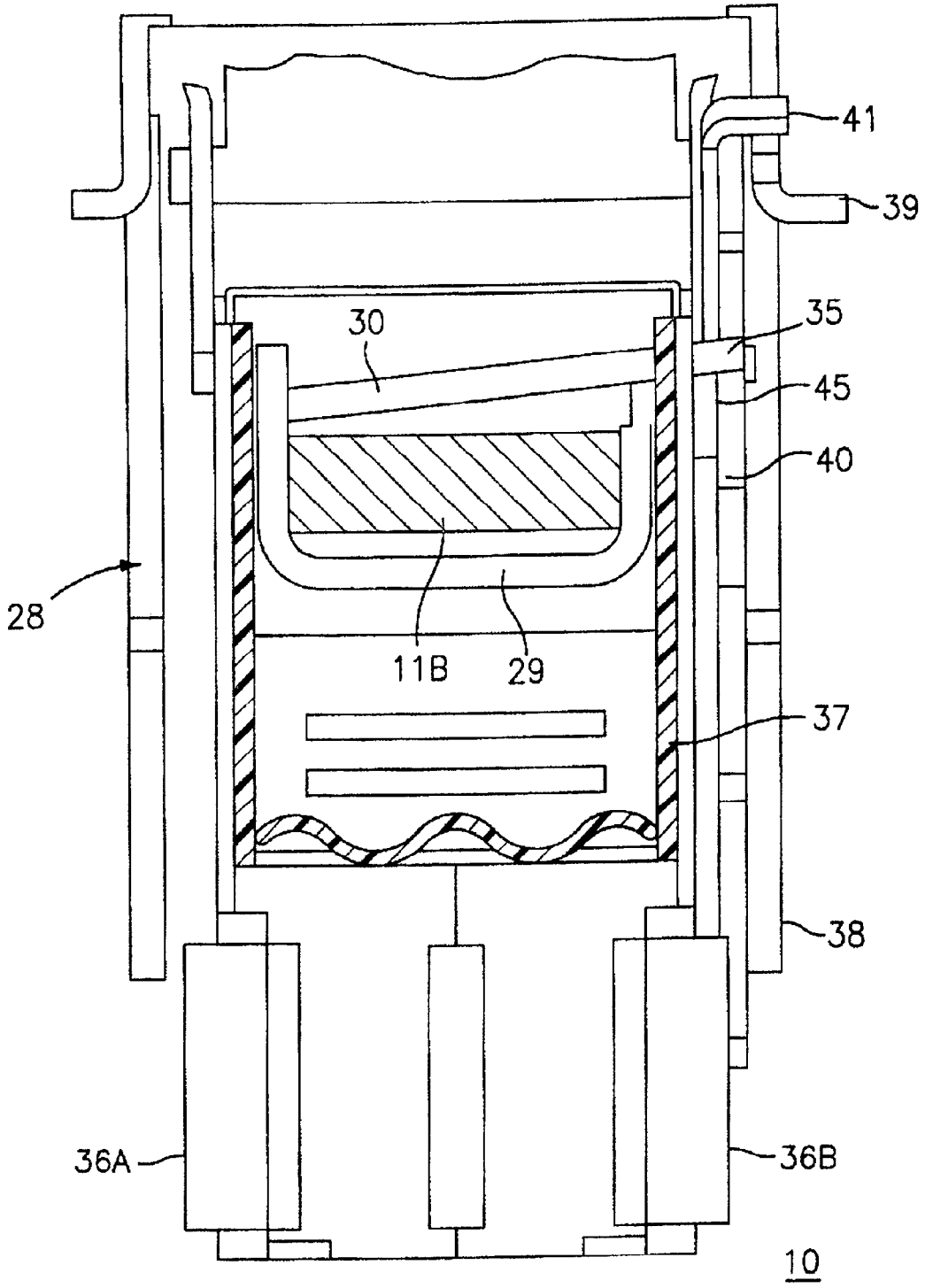
FIG. 2 is an end view of the circuit breaker assembly of FIG. 1 with the supplemental magnetic trip unit attached to the load strap.

The circuit breaker operating mechanism contained within the operating mechanism sideframe 38, shown in FIG. 2, is described on U.S. Pat. No. 5,797,483 entitled Operating Mechanism Linkage Assembly for High Ampere-Rated Circuit Breakers, which is incorporated by reference. The magnet/armature assembly 29, 30 of the supplemental magnetic trip unit 28 is shown arranged around the top part 11B of the load strap 11 (FIG. 1) within the cassette 36A and B and with the armature actuator arm 35 over the top arm 45 of the trip slide assembly 40.

Figure 3:
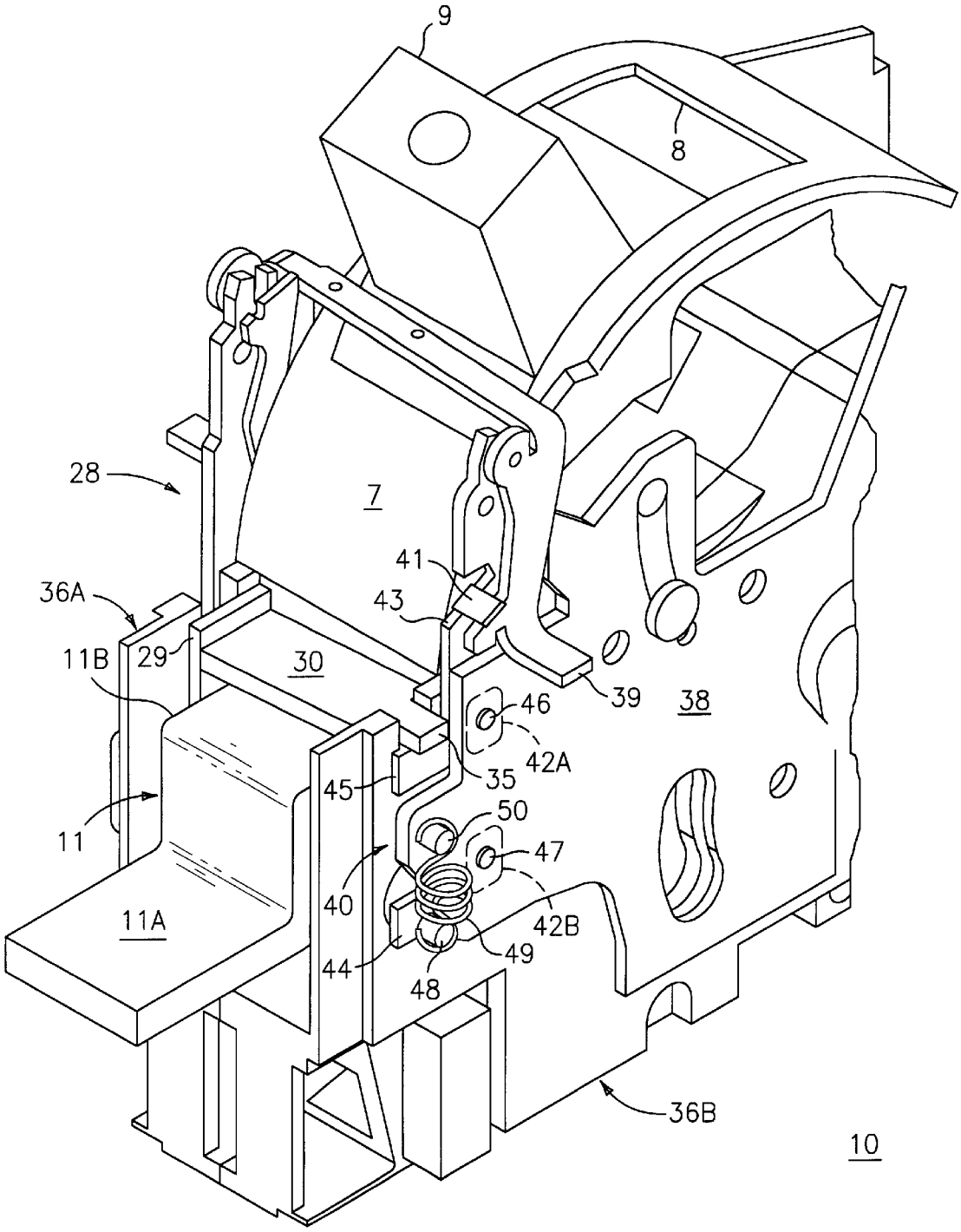
FIG. 3 is a top perspective view of the load end of the circuit breaker of FIG. 2.

The supplemental magnetic trip unit 28 is now shown within the rotary contact assembly 10 at the load end of the circuit breaker operating mechanism sideframe 38 of FIG. 3 containing the circuit breaker operating mechanism described within the above-mentioned U.S. Pat. No. 5,797,483. The circuit breaker operating handle 9 is shown extending through the operating handle slot 8 formed within the operating handle cover 7 extending over the supplemental magnetic trip unit 28. As described earlier, the magnet/armature assembly 29, 30 surrounds the top part 11B of the load strap 11 with the bottom part 11A arranged for connection with an electric distribution circuit. The actuator arm 35 is superjacent a top arm 45 of the trip slide unit 40, with a return spring 49 extending between pin 48 on the bottom arm 44 of the shaped plate 43 and a pin 50 on the operating mechanism sideframe 38. Additional operating mechanism sideframe pins 46, 47 serve to guide translation of the shaped plate 43 by means of the elongated slots 42A and B. Upon occurrence of a high overcurrent condition, such as a short circuit, within the associated electrical distribution circuit, the powerful magnetic field developed between the magnet/armature assembly 29, 30 rapidly strikes the armature 30 and actuator arm 35 downward against arm 45 driving the slide plate 43 downwardly against the bias of return spring 49 to move trip tab 41 on the top of the slide plate 43 allowing the operating mechanism latch to rotate in a counterclockwise direction and articulate the circuit breaker operating mechanism to separate the circuit breaker contacts 23, 24 and 25, 26 (FIG. 1) in the manner described in the aforementioned U.S. Pat. No. 5,797,483 and disconnect the associated electric distribution circuit. The slide plate is then returned to its home position by the return bias provided by the return spring 49 to allow circuit breaker operating mechanism to close the circuit breaker contacts upon cessation of the fault condition.

An auxiliary magnetic trip unit has herein been described in the form of a simple magnet and armature arranged around the circuit breaker load strap for articulation of the circuit breaker operating mechanism independent of the circuit breaker electronic trip unit by interaction of a trip slide upon occurrence of a short circuit overcurrent condition.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A magnetic trip unit for a circuit breaker load strap comprising:

a U-shaped magnet having a first upstanding sidearm, a second upstanding sidearm, and a slot extending through said first upstanding sidearm;

a generally platelike armature having a main body portion, the main body portion having a first end and a second end, the armature further having a pivot arm extending from the first end of the main body portion and an actuator arm extending from the second end of the main body portion, said pivot arm being partially captured within said slot in the U-shaped magnet; and a trip slide plate having a main section, the main section having a top end, a bottom end opposite the top end, a first side, and a second side opposite the first side, the trip slide plate further having a trip tab extending from the top end of the main section and a top arm and a bottom arm extending from the first side of the main section, said top arm positioned under said actuator arm, said actuator arm becoming attracted to said top arm when said magnet and said armature encompass a part of said load strap upon transfer of current of a predetermined value through said load strap.

2. The magnetic trip unit of claim 1 further including:

a top elongated slot and a bottom elongated slot formed through said main section of said trip slide plate, said top elongated slot and said bottom elongated slot adapted to capture first and second pins extending from a circuit breaker operating mechanism sideframe.

3. The magnetic trip unit of claim 2 further including:

a trip slide plate spring retainer pin extending from said bottom arm adjacent the bottom end of the main section of the trip slide plate.

4. The magnetic trip unit of claim 3 wherein said trip tab is angularly offset from said main section of said trip slide plate, and, upon transfer of current of a predetermined value through said load strap, said actuator arm of said armature presses downwardly upon said top arm of said trip slide plate and said trip tab moves correspondingly downwardly, and further wherein said trip tab is adapted to interact with a circuit breaker operating mechanism latch when the top arm of said trip slide plate is moved downwardly.

5. The magnetic trip unit of claim 4 including:

a return spring connecting between said trip slide plate spring retainer pin and a circuit breaker operating mechanism trip retainer pin for returning said trip slide plate to a home position after completion of articulation of a circuit breaker operating mechanism.

6. The magnetic trip unit of claim 5 including:

a non-metallic cassette, said non-metallic cassette housing said armature, magnet and trip slide plate.

7. The magnetic trip unit of claim 6 including:

arc gas release slots formed on said cassette.

8. A circuit breaker having first and second pairs of separable contacts arranged on opposite ends of a circuit breaker contact arm within a circuit breaker operating mechanism sideframe, a load strap connecting with the first pair of separable contacts which are separated upon occurrence of predetermined overcurrent conditions through said contacts, said circuit breaker comprising:

a U-shaped magnet having a first upstanding sidearm, a second upstanding sidearm, and a slot extending through said first upstanding sidearm;

a generally platelike armature having a main body portion, the main body portion having a first end and a second end, the armature further having a pivot arm extending from the first end of the main body portion and an actuator arm extending from the second end of the main body portion, said pivot arm being partially captured within said slot in the U-shaped magnet; and a trip slide plate having a main section, the main section having a top end, a bottom end opposite the top end, a first side, and a second side opposite the first side, the trip slide plate further having a trip tab extending from the top end of the main section and a top arm and a bottom arm extending from the first side of the main section, said top arm positioned under said actuator arm, said actuator arm becoming attracted to said top arm when said magnet and said armature encompass a part of said load strap upon transfer of current of a predetermined value through said load strap.

9. The circuit breaker of claim 8 further including:

a top elongated slot and a bottom elongated slot formed through said main section of said trip slide plate, and first and second pins arranged on said circuit breaker operating mechanism sideframe, said first and second pins extending through said top elongated slot and said bottom elongated slot, respectively.

10. The circuit breaker of claim 9 further including:

a trip slide plate spring retainer pin extending from said bottom arm adjacent the bottom end of the main section of the trip slide plate.

11. The circuit breaker of claim 10 wherein said trip tab is angularly offset from said main section of said trip slide plate, and, upon transfer of current of a predetermined value through said load strap, said actuator arm of said armature presses downwardly upon said top arm of said trip slide plate and said trip tab moves correspondingly downwardly, and further wherein said trip tab presses upon a circuit breaker operating mechanism latch when the top arm of said trip slide plate is moved downwardly.

12. The circuit breaker of claim 11 including:

a return spring connecting between said trip slide plate spring retainer pin and a circuit breaker operating mechanism trip retainer pin for returning said trip slide plate to a home position after completion of articulation of a circuit breaker operating mechanism.

13. The circuit breaker of claim 12 including:

a non-metallic cassette, said non-metallic cassette housing said armature, said magnet, and trip slide plate.

14. The circuit breaker of claim 12 wherein said trip slide plate is moveably-attached to said operating mechanism sideframe.

* * * * *